United States Patent [19]

Schoepe et al.

[11] Patent Number: 5,042,095

[45] Date of Patent: Aug. 27, 1991

[54] CLEANER INJECTOR SYSTEM

[75] Inventors: Adolf Schoepe; Oscar Dufau, both of Fullerton, Calif.

[73] Assignee: Fluidmaster, Inc., Los Angeles, Calif.

[21] Appl. No.: 116,380

[22] Filed: Nov. 3, 1987

[51] Int. Cl.[5] ..... E03D 9/02

[52] U.S. Cl. ..... 4/225

[58] Field of Search ..... 4/223-225, 4/228

[56] References Cited

U.S. PATENT DOCUMENTS

| | | | |
|---|---|---|---|
| 618,349 | 1/1899 | Heany | 4/225 |
| 1,205,513 | 11/1916 | Carlson . | |
| 1,291,428 | 1/1919 | Currie . | |
| 2,479,842 | 8/1949 | Kirwan | 4/224 |
| 2,989,185 | 6/1961 | Lombardi | 210/65 |
| 2,993,214 | 7/1961 | Franco | 4/228 |
| 3,118,462 | 1/1964 | Pannutti | 137/268 |
| 3,290,698 | 12/1966 | Joyner et al. | 4/228 |
| 3,304,564 | 2/1967 | Green et al. | 15/1.7 |
| 3,327,325 | 6/1967 | Roger | 4/227 |
| 3,556,141 | 1/1971 | Hind . | |
| 3,890,657 | 6/1975 | Gray . | |
| 3,974,847 | 8/1976 | Hodges . | |
| 4,183,108 | 1/1980 | Hamilton . | |
| 4,319,369 | 3/1982 | Lippincott, Sr. . | |
| 4,429,423 | 2/1984 | Syrenne . | |
| 4,656,676 | 4/1987 | Dufau et al. | 4/228 |

FOREIGN PATENT DOCUMENTS

| | | |
|---|---|---|
| 624260 | 7/1961 | Canada . |
| 18200031 | 3/1983 | Finland . |
| 211271 | 2/1924 | United Kingdom . |

*Primary Examiner*—Charles E. Phillips

*Attorney, Agent, or Firm*—Arthur Freilich; Robert D. Hornbaker; Leon D. Rosen

[57] ABSTRACT

An apparatus is provided which enables a container of cleaning fluid to lie in a water closet and dispense cleaning fluid solely into the toilet bowl rather than into the water closet. The apparatus includes a storage chamber (54) for holding granules of a chemical that dissolves in water to create cleaning fluid, and a transfer chamber (64) through which water flows from a refill valve outlet (40) into a standpipe (44) that leads to the toilet bowl, at each flushing of the toilet. The transfer chamber is coupled to the storage chamber so that cleaning fluid can migrate from the storage chamber (54) into the transfer chamber (64), and yet during each flushing the water from the refill outlet primarily sweeps out cleaning fluid in the transfer chamber. An anti-siphon device (74) between the refill valve outlet and the cleaning fluid dispensing apparatus includes a check valve, and a chamber that surrounds the check valve. The anti-siphon chamber has air holes that let water in the anti-siphon chamber drain into the transfer chamber when water is no longer supplied from the refill outlet, the holes being blocked during flow from the refill outlet.

7 Claims, 2 Drawing Sheets

CLEANER INJECTOR SYSTEM

BACKGROUND OF THE INVENTION

Cleaning fluids are useful in keeping toilet bowls clean. Since water for flushing the toilet bowl and refilling it passes through a water closet, it is desirable to store the cleaning fluid in the water closet and dispense it from there into the toilet bowl. Although the cleaning fluid can be mixed with the water in the water closet, this has the disadvantage that much of the cleaning fluid will be wasted when passed through the toilet bowl during flushing, and only a small portion will lie in the toilet bowl after it has been filled at the end of the flushing. Also, some cleaning fluids which are especially effective at cleaning the toilet bowl, can corrode parts lying within the water closet. Some cleaning chemicals are available as granules which can dissolve in water, so that a long term supply of cleaning chemical can be contained in a small space by repeatedly mixing water with it.

It is desirable to dispense cleaning fluid held within a container in the water closet, along with refill water. Such refill water flows from a refill valve into a standpipe into the toilet bowl, to slowly fill the toilet bowl at the end of each flushing. One technique for accomplishing this is to place a venturi along the pipe that connects the refill valve outlet to the standpipe, to create a vacuum that can draw chemical-containing water from a container to flow with the refill water. However, where the refill container holds granules or powder for long term use, new water must be continually added to the container to replace the chemical-containing water drawn out of it. U.S. Pat. No. 4,429,423 by Syrenne describes a system of this type, but wherein the openings for admitting new water allow some of the chemical-containing water to pass out into the water closet. A simple cleaning fluid dispenser which held a concentrated cleaning chemical, and which repeatedly mixed the concentrated chemical with water and directed the solution into a toilet bowl, without allowing the cleaning fluid to flow into the water closet, and which enabled simple replacement of the cleaning chemical, would be of considerable value.

SUMMARY OF THE INVENTION

In accordance with one embodiment of the present invention, a cleaning fluid dispenser apparatus is provided, which enables the dispensing of cleaning fluid from a concentrated supply into a toilet bowl during its refill, while avoiding the dispensing of cleaning chemical into the water closet. The apparatus includes a transfer chamber with an inlet coupled to a refill valve and an outlet coupled to a standpipe, so refill water passes through the chamber to sweep out cleaning chemical therein. A replenishing means is coupled to the chamber to introduce additional cleaning chemical into the chamber between flushings. The replenishing means can include a storage chamber which holds concentrated cleaning fluid, and which is coupled to the transfer chamber to allow the migration of cleaning fluid from the storage chamber to the transfer chamber. Between flushings, the transfer chamber receives cleaning fluid, and the cleaning fluid in the transfer chamber is flushed out at the end of each toilet flushing when refill water passes through the transfer chamber to the standpipe to refill the toilet bowl.

An anti-siphon device can be placed between the refill valve outlet and the cleaning fluid dispensing apparatus to prevent the backflow of cleaning fluid into the water system. The anti-siphon device includes a chamber with a check valve at the inlet and with at least one air hole at the top which is covered on the inside by a soft elastomeric plate. Refill water entering the inlet is deflected against the elastomeric plate to keep it closed against the air holes. When refill water stops flowing in, and water in the anti-siphon chamber can flow out towards the cleaning fluid apparatus, the plate can deflect away from the air hole to allow such outward water flow. The outlet of the anti-siphon chamber is higher than the outlet that empties water into the standpipe.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
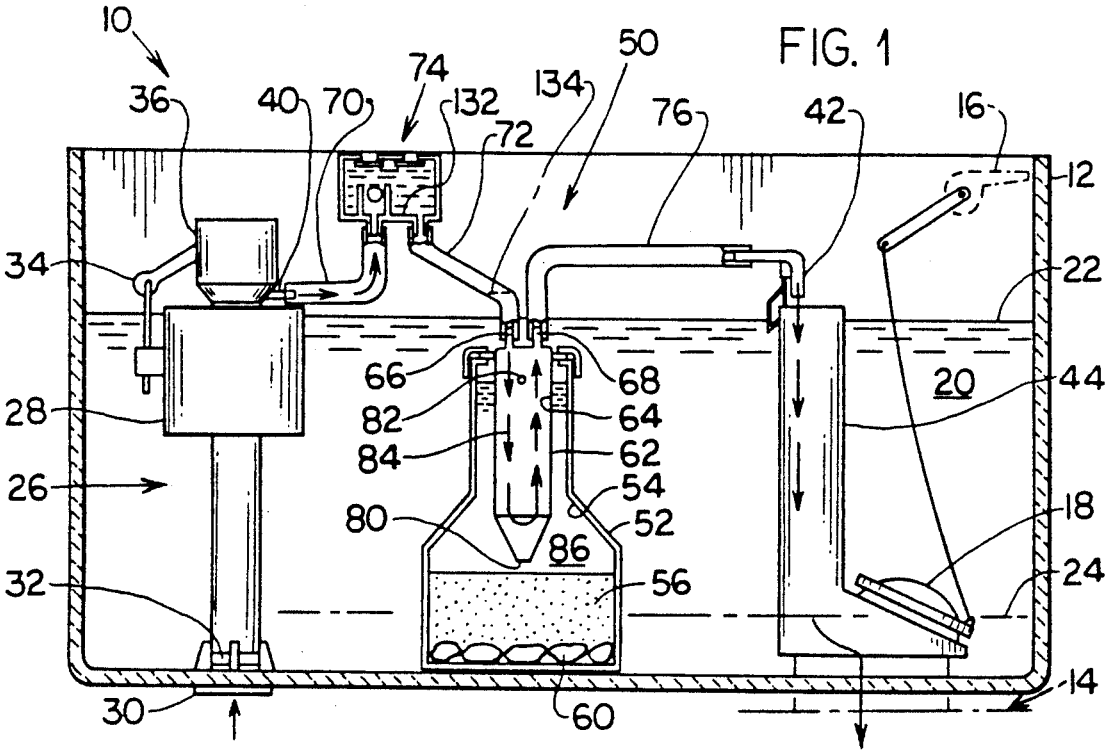
FIG. 1 is a sectional view of a water closet containing the fluid dispenser apparatus of the present invention, and showing its operation during refilling of the toilet bowl.

FIG. 1 illustrates a portion of a toilet 10 which includes a water closet 12 that holds water to flush a toilet bowl indicated at 14. As in the prior art, flushing is accomplished when a person pivots down a lever 16 which causes a flush valve 18 to pivot open and allow water 20 in the water closet to pass out through the flush valve 18 into the toilet bowl. The water level quickly drops from the maximum level 22 to a minimum level 24, and the flush valve immediately closes. A ballcock 26 includes a float 28 which drops when the water level drops, to allow water from a main water supply 30 to pass out of a main flow outlet 32 into the water colset to refill it. Refilling continues until the water reaches its maximum level 22, when the float 28 will have risen far enough to move levers 34 to close a ballcock valve 36 to stop the outward water flow.

During the entire time that main flushing water passes out of the main outlet 32, a smaller amount of water passes out of a ballcock refill valve outlet 40, to pass out of a refill nozzle 42 into an overflow pipe or standpipe 44. Water moving down the overflow pipe 44 passes around the flush valve 18 to flow directly into the toilet bowl 14 to refill it. While almost all of the water closet water passing out of the flush valve 18 passes through the toilet bowl to flush out waste, and only a small portion remains in the toilet bowl, almost all of the refill water passing out of the refill nozzle 42 is captured in the toilet bowl and remains there until the next flushing.

Applicant provides a cleaning fluid dispenser apparatus 50 for dispensing a cleaning fluid to the toilet bowl to keep it clean. The apparatus includes a storage container 52 having walls forming a storage chamber 54 that stores a concentrated cleaning chemical 56 that is generally in a solid form such as in the form of granules or powder. It may be noted that the container includes ballast 60 such as several stones, to hold down the container so it does not float. The apparatus also includes a transfer container 62 having walls forming a transfer chamber 64, and having a transfer inlet 66 and a transfer outlet 68. The transfer inlet 66 is coupled through a pair of tubes 70, 72 and an anti-siphon device 74 to the refill outlet 40. The transfer outlet 68 is coupled through a tube 76 to the refill nozzle 42. During the time that the water level in the water closet rises as from level 24 to level 22, which occurs after a flushing, water passing out of the refill valve outlet 40 passes through the transfer chamber 64 to the refill nozzle 42 to refill the toilet bowl.

The transfer chamber 64 has a small migration hole 80 and a small air escape hole 82 that couple it to the storage chamber 54. However, the transfer chamber is primarily a closed chamber so that water passing through it from the inlet 66 to the outlet 68 primarily sweeps out liquid already lying in the transfer chamber. The inlet 66 and outlet 68 are out of line and are both directed primarily vertically to urge water to pass in the direction indicated by arrows 84 to tend to sweep out the contents of the transfer chamber. Before each flushing, the transfer chamber generally holds water containing a high concentration of a chemical cleaner. Most of this concentrated solution is flushed out of the transfer chamber along with refill water, to fill the toilet bowl with the cleaning solution after each toilet flushing.

After each toilet flushing and the transfer out of the contents of the transfer chamber 64, the transfer chamber holds water (from the refill valve outlet 40) containing only a small amount of cleaning fluid. During those longer periods of perhaps one-half hour or more between many of the flushings, cleaning chemical from the storage chamber 54 moves into the transfer chamber 64 by migration through the migration hole 80. The storage chamber 54 includes a quantity of water 86 above the concentrated cleaning chemical 56, and the water 86 quickly becomes saturated with the cleaning chemical. The dissolved cleaning chemical migrates through the migration hole 80 into the transfer chamber 64 by several processes, including mixing of the fluids in the two chambers due to convective currents. In any case, after an extended period of time the water in the transfer chamber 64 is found to contain a high concentration of the cleaning chemical.

It would be possible to eliminate the separate transfer container 62 and connect the transfer inlet and outlet 66, 68 directly to the upper end of the storage container 52 (which would then become a transfer chamber). This would have an advantage of simplicity in construction and in insuring a high concentration of cleaning chemicals in the toilet bowl after each flushing, even if flushing occurs more frequently. However, this would have the disadvantage that the cleaning chemical would be used up more rapidly than may be desirable where there is frequent toilet flushing. To maintain the toilet bowl clean, as to avoid the buildup of deposits in water from a home water supply, especially where there is "hard" water containing a high concentration of minerals, it is desirable that at least a moderate concentrations of cleaning fluid lie in the toilet bowl a significant portion of time, but not necessarily all of the time. By passing the refill water through a transfer chamber that is coupled through a small hole to the storage chamber, applicant avoids quickly depleting the cleaning chemical if there is frequent toilet flushing, and yet generally assures that there will be a high concentration of cleaning fluid in the toilet bowl at least some of the time. For example, if the toilet is not used overnight, there will be many hours for concentrated cleaning chemical to migrate into the transfer structure, to pass into the toilet bowl at the next flushing.

The air escape hole 82 allows air at the top of the transfer chamber 64 to bleed into the chamber for escape therefrom. Applicant has found that without such a hole, air entrained in water entering the storage chamber tends to accumulate, which may cause the storage chamber to float or result in fluid in the storage chamber falling to the level of the migration hole 80.

Figure 2:
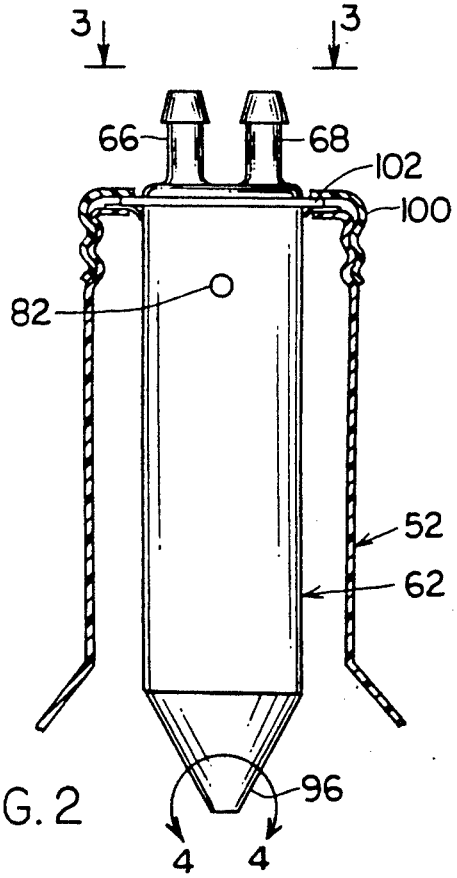
FIG. 2 is a view of a portion of the transfer chamber of FIG. 1.
Figure 3:
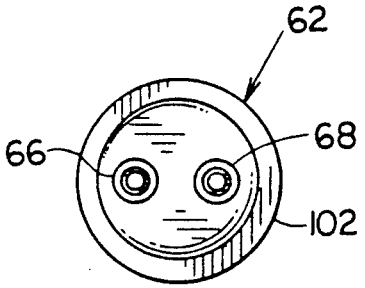
FIG. 3 is a view taken on the line 3—3 of FIG. 2.
Figure 4:
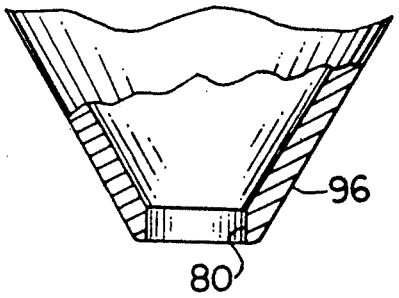
FIG. 4 is an enlarged vlew of the region 4—4 of FIG. 2.
Figure 5:
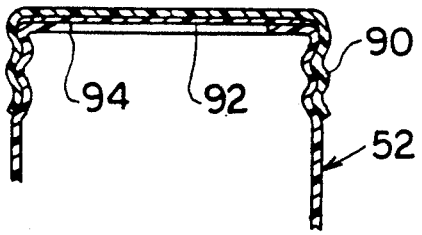
FIG. 5 is a sectional view of the top of the container of FIG. 2, as it is stored and prior to installation of the transfer chamber therein.
Figure 8:
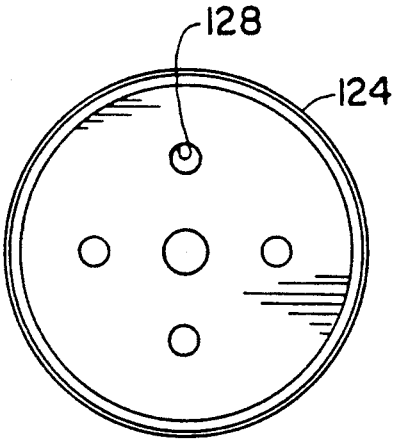
FIG. 8 is a plan view of the lid of FIG. 6.
Figure 7:
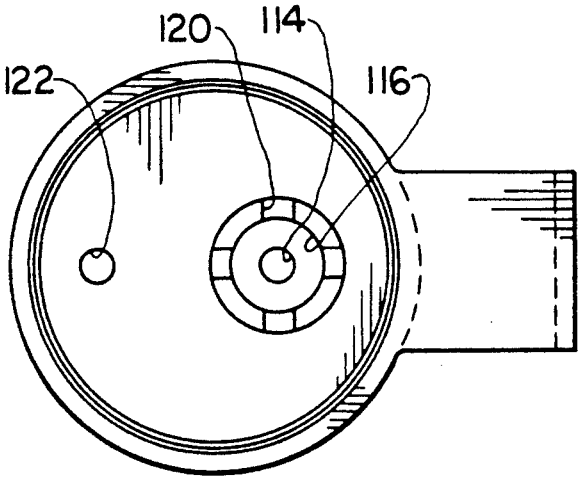
FIG. 7 is plan view of the apparatus of FIG. 6, but without the lid thereon.

The dispensing apparatus 50 is constructed to facilitate the replacement of the storage container 52 when the chemicals therein have been used up. As shown in applicant's FIG. 5, the storage container 52 is sold with a storage cap 90 that closes the top of the container. A thick metal foil 92 is bonded to an upper wall 94 of the storage container to keep it sealed even when the cap 90 is removed. After removal of the cap 90, a user presses the lower end 96 (FIG. 2) of the transfer container down through the foil 92 to pierce it. An in-use cap 100 is than screwed onto the top of the storage container 52 to trap a flange 102 of the transfer container in place. To initially set up the dispenser apparatus, various tubes have to be connected up. However, replacement of the storage container is accomplished without disconnecting and reconnecting tubes, but only by installing the transfer container in the storage container and screwing on the in-use cap. Some cleaning chemicals are highly corrossive, and the ability to replace them with minimal effort, without requiring pouring of the chemicals, is a significant advantage.

Applicant has constructed a dispensing device of the type shown in the drawings, using a transfer container 62 of a height of 3.75 inches, outside diameter along most of its length of 1 inch, and openings 80, 82 each of 0.060 inch diameter. Thus, the area of the two openings (about 0.01 square inch) is much less than 5%, and less than 1%, of the area of the walls of the transfer chamber (about 10 square inches). With the storage container holding 4 ounces of a cleaning chemical of hypochlorite granules, it was found that the water in the transfer container reached a substantially saturated solution of about 26 parts per million cleaning chemical in water about one-half hour after each flushing.

Figure 6:
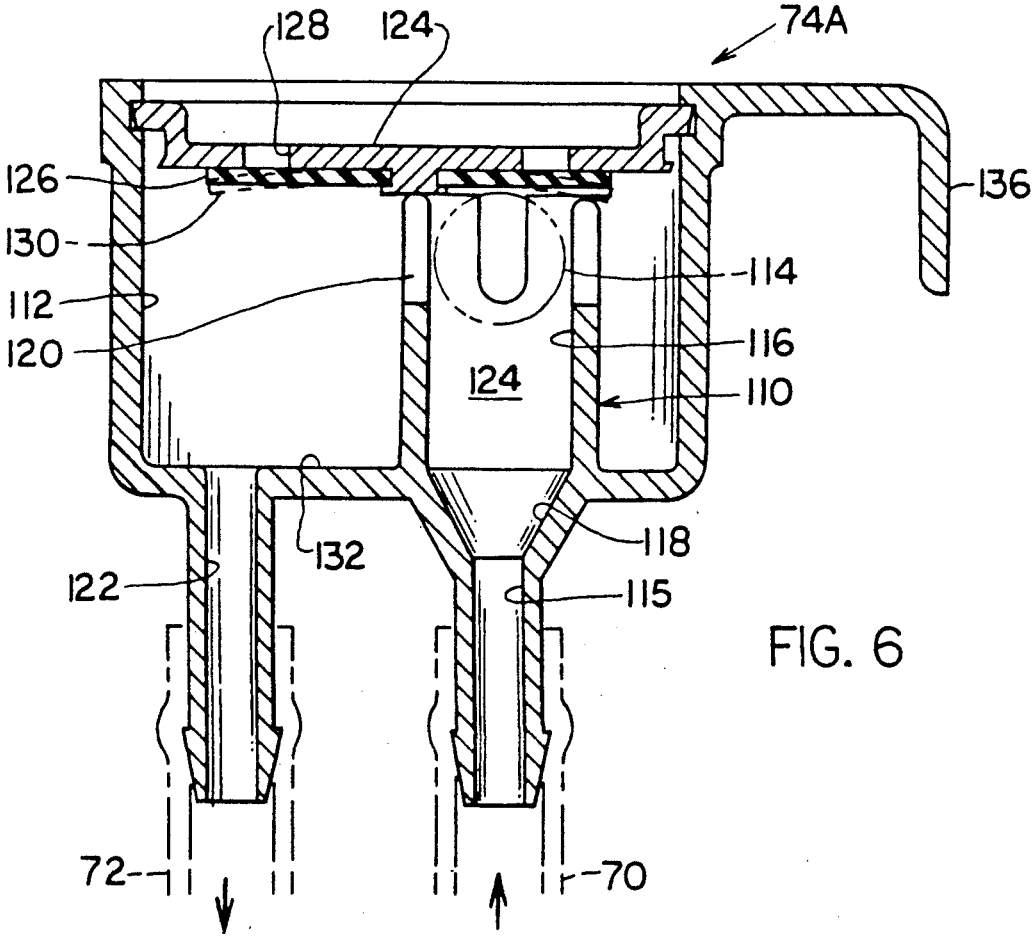
FIG. 6 is a sectional view of an anti-siphon device similar to that of FIG. 1, but in a modified configuration.

The anti-siphon device 74 serves to greatly resist the passage of cleaning fluid back into the main water supply 30. As shown in FIG. 6, which shows a design slightly modified from that of FIG. 1, the device 74A includes a check valve 110 which allows water to flow into an anti-siphon container 112 through an inlet 115 having an inlet port at its top, while resisting the reverse flow of water out of the inlet 114. The check valve includes a ball valve member 114 that moves vertically within a guide 116, and which is moved up by the pressure of water entering through tube 70. The valve member moves down against a valve seat 118 when there is no further inflow through the inlet. When the valve member 114 rises to its maximum height, water can flow through slots 120 into the chamber and then out through an outlet 122 having an outlet port at its top.

At the time when water is no longer supplied to the anti-siphon device through the tube 70, and as the ball 114 moves down, a portion of any fluid lying in the region 124 will flow back into the tube 70. If the water in the region 124 contains cleaning chemical, then some cleaning chemical could flow into the clean water supply. If a quantity of water remained in the anti-siphon chamber 112 between flushings, then some cleaning chemical could migrate from the transfer chamber through the tube 72 to the anti-siphon chamber 112 to contaminate the water therein and the water in the region 124. To avoid such contamination, the anti-siphon device is constructed to empty chamber 112 of water after each flushing.

The anti-siphon device 74A includes a lid 124 at the top, with air holes 126 leading to the ambient atmosphere. A plate 126 of soft elastomeric material such as rubber, has a central hole which is mounted to the lid and has a periphery forming free end portions that can readily deflect, as to the position 130, to open the air holes. When refill water is moving into the anti-siphon chamber, the water passing around the valve member 114 is deflected against the free end of the plate 126 to keep it blocking the air holes. However, when refill water no longer flows, the elastomeric plate 126 is free to deflect away from the air holes to open the chamber to the ambient atmosphere.

The bottom 132 of the anti-siphon chamber lies higher than the bottom of the refill nozzle 42 (FIG. 1). This allows water draining from the anti-siphon chamber to pass through the tube 72, the transfer chamber 64, tube 76, and out of the refill nozzle 72. Such drainage occurs until the level of water drops to the level indicated at 134, which is equal to the bottom of the refill nozzle 42. At the next flushing, water entering the anti-siphon chamber (FIG. 6) will be only refill water. As shown in FIG. 6, the anti-siphon device is provided with a hook 136 that hooks over the top of the water closet, to maintain the device at a high elevation.

Thus, the invention provides a cleaning fluid dispenser apparatus for use in a water closet, which efficiently uses cleaning chemicals while avoiding emplacing such chemicals into the water closet. The apparatus includes a transfer chamber with a transfer inlet and a transfer outlet that are respectively connected to the refill outlet and refill nozzle, so that most if not all of the water which passes out of the refill outlet to the nozzle first passes through the transfer chamber. The transfer chamber contains water with liquid cleaner therein, so that refill water passing through it carries out the chemical-containing water. At the end of each flushing cycle, the transfer chamber contains some refill water, and before the time of the next flushing concentrated chemical cleaning fluid is added to the refill water in the transfer chamber, as by a means such as a storage chamber, to await the next flushing. The apparatus can include separate transfer and storage chambers, the storage chamber containing the concentrated chemical and the transfer chamber being primarily closed but coupled through one or more small holes to the storage chamber to permit the migration of cleaning chemical into the transfer chamber. An anti-siphon device can be placed between the refill outlet and the transfer structure, the device including a check valve and means for drawing fluid from around the check valve member when fluid stops flowing in the forward direction through the check valve.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. Cleaning fluid dispenser apparatus for use in a water closet wherein after the toilet bowl is flushed water flows out of a refill valve outlet and into an overflow pipe type device to refill the toilet bowl comprising;

walls forming a storage chamber for holding concentrated liquid cleaning fluid;

walls forming a transfer chamber with a transfer inlet and a transfer outlet;

means for coupling said transfer and storage chambers to allow liquid to flow between them, said means for coupling forming at least one opening having a total cross-sectional area less than 5% of the area of the walls of said transfer chamber;

means for coupling said refill valve outlet to said transfer inlet and for coupling said transfer outlet to said overflow pipe, to flow water from said refill outlet through said transfer chamber to said overflow pipe.

2. The apparatus described in claim 1 wherein:

said means for coupling flows substantially all water passing from said refill outlet to said overflow pipe through said transfer chamber.

3. A cleaning fluid dispenser apparatus for dispensing a cleaning chemical through a water closet standpipe into a toilet bowl along with refill water from a refill water outlet, comprising:

a storage chamber which contains a toilet bowl cleaning chemical;

walls forming a transfer chamber lying adjacent to said storage chamber, said transfer chamber having an inlet coupled to said refill water outlet and having an outlet coupled to said standpipe;

said chambers forming at least one hole therebetween, to allow said cleaning chemical to flow into said transfer chamber;

said refill water outlet connected to said transfer chamber to pass substantially all refill water through said transfer chamber, and the total cross-sectional area of said at least one hole is less than 5% of the area of said walls forming said transfer chamber.

4. The apparatus described in claim 3 wherein:

said inlet and outlet are both located at the top of said transfer chamber and are oriented substantially vertically.

5. Cleaning fluid dispenser apparatus for use in a water closet wherein after the toilet bowl is flushed water flows out of a refill valve outlet and into a refill nozzle device or the like to refill the toilet bowl, comprising:

a transfer container having walls forming a transfer chamber and having an inlet and an outlet communicating with said chamber;

means coupling said refill valve outlet to said transfer chamber inlet and coupling said transfer chamber outlet to said refill device, for passing most of the water moving from said refill valve outlet to said refill device through said transfer chamber;

means for introducing a toilet bowl cleaning chemical into said chamber between flushings of said toilet bowl, including a storage chamber, a quantity of concentrated dissolvable cleaning chemical in said storage chamber, and means for coupling said transfer and storage chambers to allow water to circulate from said transfer chamber into said storage chamber to form a solution of water and said dissolvable chemical in said storage chamber and to allow said solution to circulate from said storage chamber into said transfer chamber;

said storage chamber having an easily pierced seal at the top and a supporting wall around said seal, and said transfer chamber has a tapered lower end which can pierce said seal and has a flange at its upper end which can rest on said supporting wall, and including an in-use cap which can attach to said storage chamber and overlie said flange to hold it down against said supporting wall.

6. Cleaning fluid dispenser apparatus for use in a water closet wherein after the toilet bowl is flushed water flows out of a refill valve outlet and into an overflow pipe or the like to refill the toilet bowl, comprising:

walls forming a storage chamber for holding concentrated liquid cleaning fluid, said storage chamber having closed upper and lower portions;

walls forming a transfer chamber with a transfer inlet and a transfer outlet, said transfer chamber lying in said upper portion of said storage chamber and having a hole which leads to said storage chamber to couple said chambers to allow liquid to flow between them;

means for coupling said refill valve outlet to said transfer inlet and for coupling said transfer outlet to said overflow pipe, to flow water from said refill outlet through said transfer chamber to said overflow pipe;

said hole lying closer to the bottom of said transfer chamber than to the top thereof, and including walls forming an air escape hole in said transfer chamber lying closer to the top of said transfer chamber than to the bottom thereof, and opening to the top of said storage chamber, whereby to drain out air.

7. Cleaning fluid dispenser apparatus for use in a water closet wherein after the toilet bowl is flushed refill water flows out of a refill valve outlet and an overflow pipe type device to refill the toilet bowl, comprising:

a transfer container having walls forming a transfer chamber and having an inlet and an outlet communicating with said chamber;

means coupling said refill valve outlet to said transfer chamber inlet and coupling said transfer chamber outlet to said refill device, for passing most of the refill water moving from said refill valve outlet to said refill device through said transfer chamber, said transfer chamber being small enough so most of the contents of the transfer chamber are flushed out into the toilet bowl by said refill water after each flushing of the water closet;

means for introducing a toilet bowl cleaning chemical into said chamber between flushings of said toilet bowl;

said means for introducing a chemical includes walls forming a storage chamber, a quantity of concentrated dissolvable cleaning chemical in said storage chamber, and means forming at least one opening between said transfer and storage chambers to allow water to circulate from said transfer chamber into said storage chamber to form a solution of water and said dissolvable chemical in said storage chamber and to allow said solution to circulate from said storage chamber into said transfer chamber, said transfer chamber walls having a predetermined area and said at least one opening having an area no more than 1% of the area of said walls of said transfer chamber.

* * * * *